US011030968B2

(12) United States Patent
Slavenburg et al.

(10) Patent No.: US 11,030,968 B2
(45) Date of Patent: Jun. 8, 2021

(54) MIDDLE-OUT TECHNIQUE FOR REFRESHING A DISPLAY WITH LOW LATENCY

(71) Applicant: NVIDIA Corporation, Santa Clara, CA (US)

(72) Inventors: Gerrit Slavenburg, Hayward, CA (US); Tom J. Verbeure, Sunnyvale, CA (US)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 16/844,126

(22) Filed: Apr. 9, 2020

(65) Prior Publication Data

US 2020/0243033 A1 Jul. 30, 2020

Related U.S. Application Data

(60) Provisional application No. 62/969,599, filed on Feb. 3, 2020.

(51) Int. Cl.
*G09G 5/00* (2006.01)
*G09G 3/36* (2006.01)

(52) U.S. Cl.
CPC ... *G09G 3/3674* (2013.01); *G09G 2310/0286* (2013.01); *G09G 2320/0252* (2013.01); *G09G 2360/18* (2013.01)

(58) Field of Classification Search
CPC ..... G09G 3/3674; G09G 3/3677; G09G 2310/0213; G09G 2310/0221; G09G 2310/0286; G09G 2320/0252; G09G 2360/12; G09G 2360/18
See application file for complete search history.

(56) References Cited

U.S. PATENT DOCUMENTS 5,754,234 A * 5/1998 Kitsuki ..... G06T 9/007 348/394.1
6,396,941 B1 * 5/2002 Bacus ..... G06T 3/4038 382/128
7,646,927 B2 * 1/2010 Matsubara ..... H04N 19/64 382/233
8,411,949 B2 * 4/2013 Kuroki ..... G06T 11/40 382/173
9,639,788 B2 * 5/2017 Kumarasamy ..... G06K 15/1865
2003/0156114 A1 * 8/2003 Emmot ..... G09G 5/39 345/531
2004/0196483 A1 * 10/2004 Jacobsen ..... H04N 1/0473 358/1.13
2006/0066621 A1 * 3/2006 Herceg ..... G06T 11/40 345/501

(Continued)

*Primary Examiner* — Joe H Cheng
(74) *Attorney, Agent, or Firm* — Shook, Hardy & Bacon L.L.P.

(57) ABSTRACT

In various examples, images rendered by a processor—such as a graphics processing unit (GPU)—may be scanned out of memory in a middle-out scan order. Various architectures for liquid crystal displays (LCDs) may be implemented to support middle-out scanning, such as dual-panel architectures, ping-pong architectures, and architectures that support both top-down scan order and middle-out scan order. As a result, display latency within the system may be reduced, thereby increasing performance of the system—especially for high-performance applications such as gaming.

20 Claims, 9 Drawing Sheets

(56) References Cited

U.S. PATENT DOCUMENTS

| | | | | |
|---|---|---|---|---|
| 2015/0042669 | A1* | 2/2015 | Van Nostrand | G09G 5/395 345/545 |
| 2015/0170561 | A1* | 6/2015 | Ahn | G09G 3/2022 345/691 |
| 2017/0270393 | A1* | 9/2017 | Suzuki | G06K 15/1855 |

* cited by examiner

MIDDLE-OUT TECHNIQUE FOR REFRESHING A DISPLAY WITH LOW LATENCY

CROSS-REFERENCE TO RELATED APPLICATIONS

This application claims the benefit of U.S. Provisional Application No. 62/969,599, filed on Feb. 3, 2020, which is hereby incorporated by reference in its entirety.

BACKGROUND

Latency is an important consideration for any display technology, and becomes increasingly important in high-performance applications—such as gaming. For example, an important performance factor for measuring quality of a user experience is the delay between the completion of a rendering of an image—such as by a graphics processing unit (GPU)—and a display showing the image (often referred to as "display latency"). In many applications, a center or middle region of an image contains the most important visual cues and, as a result, display latency is often measured from a starting time at which a first pixel is scanned out for display until a pixel corresponding to a center or middle of an image is scanned out for display. However, conventional systems execute a scan order that begins with a top row of pixels, scans from left to right across the row, then proceeds to a next row, scans from left to right across the row, and so on, until the entire image is scanned out from top left to bottom right of the display. Since the display needs to update the top half of the image prior to reaching a center or middle region of the display, a significant part of the display latency is consumed by the time to scan from the top of the image to the middle of the screen. The display latency from this top-down approach may reduce the performance of a user within an application—such as a gaming application—thereby causing a negative effect on the user experience.

Some conventional approaches to remedying delay issues rely on video compression technologies, or codecs, that reduce a number of bits associated with an image such that transmitting the image from one device to another happens more quickly with reduced bandwidth requirements. While these compression techniques may reduce overall latency within a system, they do not have an effect on a reduction in display latency. For example, even where a compression technique is implemented, the image still needs to be reconstructed because data corresponding to each pixel still needs to be scanned out for display. As such, compression technologies may reduce latency on the front-end of an application, but the back-end of the application—e.g., scanning the rendered image from memory to a display—does not benefit from a display latency reduction as a result.

SUMMARY

Embodiments of the present disclosure relate to techniques for efficiently refreshing a display—such as a liquid crystal display (LCD)—to reduce display latency. Systems and methods are disclosed that scan out an image from a middle of a display—or a location other than a top-most or bottom-most portion of a display—to a top and bottom of the display such that a central or middle portion of the display is updated or refreshed more quickly. Various hardware architectures, such as those described herein, may enable this efficient display refresh to decrease the display latency associated with conventional systems, and thereby provide a better user experience—especially for high-performance applications such as gaming.

In contrast to conventional systems, such as those described above, once an image is rendered and ready for display—e.g., stored in a frame buffer—the image may be scanned out from a center or middle of a display to a top and bottom of the display (e.g., a middle-out scan). As a result, display latency is reduced to an amount of time it takes the system to scan out one-half line or row of pixels. With respect to a 1080p, 60 Hz display, the display latency for a middle-out scan order may be reduced to approximately 7.5 μs from approximately 8.3 ms for a top-down scan order. To accommodate a middle-out scan order, various hardware implementations may be implemented. For example, a display may be split into two separate panels—e.g., a top half and a bottom half—and the top panel may be updated from the bottom-up and the bottom panel may be updated from the top-down. As a result, the display may be updated from middle-out at twice the rate of conventional systems—e.g., because the top panel and the bottom panel may be updated at the same time. In other examples, the display may include an architecture that enables updating in a back and forth—or ping-pong—order from middle-out, such that a first approximately centrally located row may be scanned out first, then a second row above the first row, then a third row below the first row, and so on. As another example, a display architecture may be implemented that allows for both top-down and middle-out scanning, such that hardware logic—e.g., a combo shift register element—may be employed to accommodate systems that may not be capable of middle-out scanning—e.g., where a processor is not configured for middle-out scanning. In any of the various architectures described herein, the display latency may be reduced such that—in combination with compression techniques or other latency reduction techniques—the overall latency of the system may be reduced to increase the performance and user experience for a variety of applications.

BRIEF DESCRIPTION OF THE DRAWINGS

The present systems and methods for a middle-out technique for efficiently refreshing a display are described in detail below with reference to the attached drawing figures, wherein.

DETAILED DESCRIPTION

Systems and methods are disclosed related to a middle-out technique for efficiently refreshing a display. Although embodiments of the present disclosure may be described primarily with respect to liquid crystal displays (LCDs), this is not intended to be limiting, and the systems and methods described herein may be implemented for other display technologies—e.g., light-emitting diode (LED), organic LED (OLED), micro-LED, active-matrix OLED (AMOLED), plasma, thin film transistor (TFT), cathode ray tube (CRT), LED/LCD, etc. In addition, although the present disclosure may be described primarily with respect to a single layer LCD, this is not intended to be limiting, and the systems and methods described herein may be implemented for any number of layers—e.g., dual-layer LCDs, multi-layer LCDs, etc. As described herein, a middle row or line of pixels of an image may include a single middle row (e.g., where a resolution dimension corresponds to an odd number of rows or lines) or may include one or both of two middle rows (e.g., where the resolution dimension corresponds to an even number of rows of lines).

Figure 1:
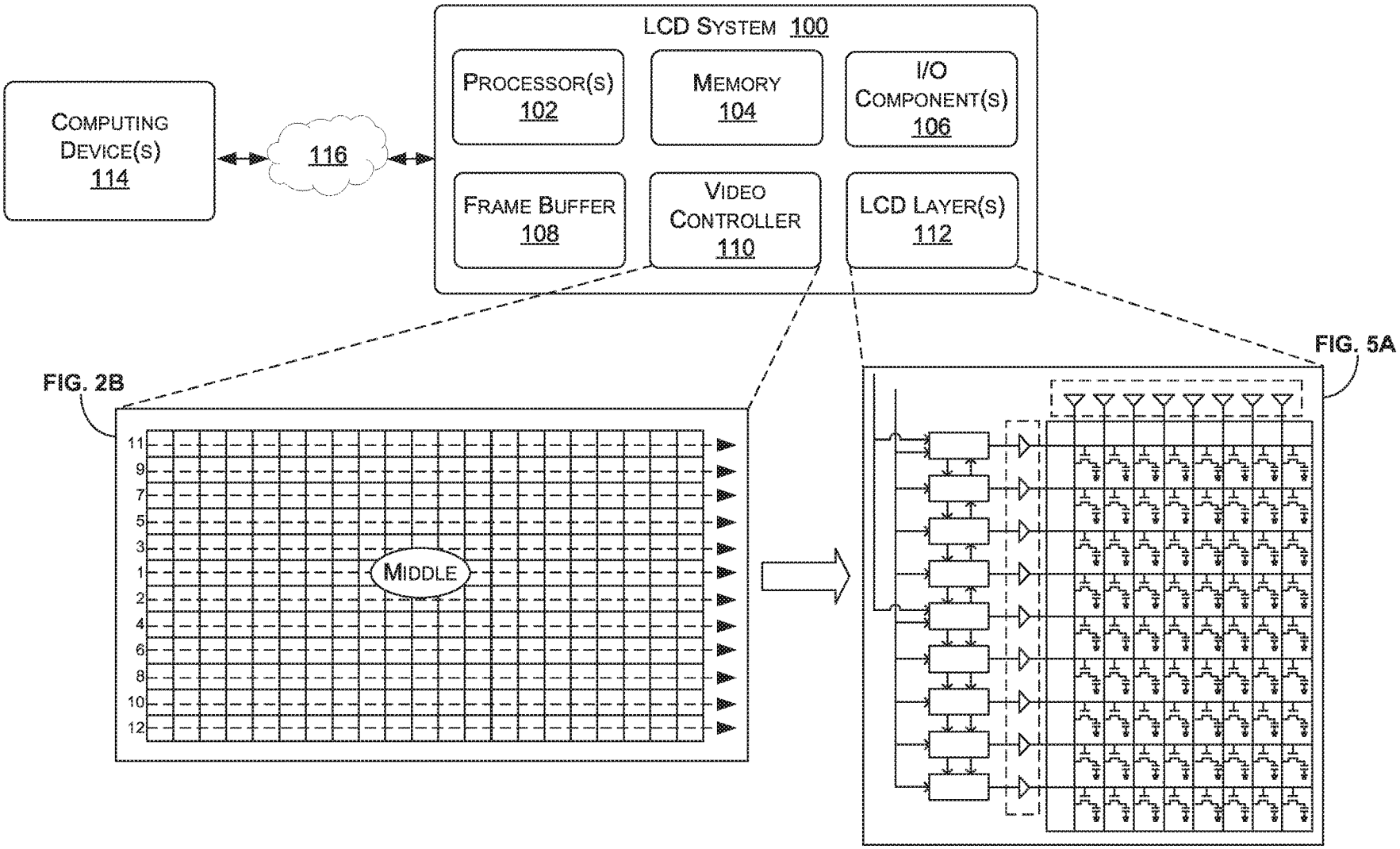
FIG. 1 depicts a liquid crystal display (LCD) system, in accordance with some embodiments of the present disclosure.

Now referring to FIG. 1, FIG. 1 depicts a liquid crystal display (LCD) system 100, in accordance with some embodiments of the present disclosure. It should be understood that this and other arrangements described herein are set forth only as examples. Other arrangements and elements (e.g., machines, interfaces, functions, orders, groupings of functions, etc.) may be used in addition to or instead of those shown, and some elements may be omitted altogether. Further, many of the elements described herein are functional entities that may be implemented as discrete or distributed components or in conjunction with other components, and in any suitable combination and location. Various functions described herein as being performed by entities may be carried out by hardware, firmware, and/or software. For instance, various functions may be carried out by a processor executing instructions stored in memory. In some embodiments, one or more of the components, features, and/or functionalities of the LCD system 100 may correspond to or be executed using one or more components, features, and/or functionalities of example computing device 700 of FIG. 7, described herein. In addition, one or more of the components, features, and/or functionalities of the LCD system 100 may correspond to or be executed using one or more alternative or additional components, features, and/or functionalities other than those described with respect to the example computing device 700 of FIG. 7.

The LCD system 100 (abbreviated as "system 100" herein) may include one or more processors 102 (e.g., central processing units (CPUs), graphics processing units (GPUs), etc.), memory 104 (e.g., for storing image data rendered by the processor(s) 102 in the frame buffer 108, etc.), input/output (I/O) component(s) 106 (e.g., a keyboard, a mouse, a remote, a game controller, a touch screen, etc.), a frame buffer 108, a video controller 110 (e.g., for encoding, decoding, and/or scanning out the image according to a scan order), an LCD layer(s) 112, and/or additional or alternative components, features, and functionality. In some embodiments, the system 100 may correspond to a single device (e.g., an LCD television), or a local device (e.g., a desktop computer, a laptop computer, a tablet computer, etc.), and the components of the system 100 may be executed locally on the system 100.

In other embodiments, some or all of the components of the system 100 may exist separately from the display device—e.g., LCD display device. For example, the I/O component(s) 106, the memory 104, the processor(s) 102, the frame buffer 108, the video controller 110, and/or other components may be part of another system separate from the display device. For example, the LCD system 100 may be a component or node of a distributed computing system—such as a cloud-based system—for streaming images, video, video game instances, etc. In such embodiments, the LCD system 100 may communicate with one or more computing device(s) 114 (e.g., servers) over a network 116 (e.g., a wide area network (WAN), a local area network (LAN), or a combination thereof, via wired and/or wireless communication protocols). For example, a computing device(s) 114 may generate and/or render an image, encode the image, and transmit the encoded image data over the network 116 to another computing device (e.g., a streaming device, a television, a computer, a smartphone, a tablet computer, etc.). The receiving device may decode the encoded image data, reconstruct the image (e.g., assign a color value to each pixel), store the reconstructed image data in the frame buffer 108, scan the reconstructed image data out of the frame buffer 108—e.g., using the video controller 110—according to a scan order (e.g., middle-out, top-down, etc.) to generate display data, and then transmit the display data for display by a display device (e.g., an LCD) of the system 100. Where the image data is encoded, the encoding may correspond to a video compression technology such as, but not limited to, H.264, H.265, M-JPEG, MPEG-4, etc.

As another example, the computing device(s) 114 may include a local device—e.g., a game console, a disc player, a smartphone, a computer, a tablet computer, etc. In such embodiments, the image data may be transmitted over the network 116 (e.g., a LAN) via a wired and/or wireless connection. For example, the computing device(s) 114 may render an image (which may include reconstructing the image from encoded image data), store the rendered image in the frame buffer 108, scan out the rendered image—e.g., using the video controller 110—according to a scan order to generate display data, and transmit the display data to a display device for display.

As such, whether the process of generating a rendered image for storage in the frame buffer 108 occurs internally (e.g., within the display device, such as a television), locally (e.g., via a locally connected computing device 114), remotely (e.g., via one or more servers in a cloud-based system), or a combination thereof, the image data representing values (e.g., color values, etc.) for each pixel of a display may be scanned out of the frame buffer 108 (or other memory device) to generate display data (e.g., representative of voltage values, capacitance values, etc.) configured for use by the display device—e.g., in a digital and/or analog format. In addition, the display device—e.g., LCD layer(s) 112 of an LCD panel—may be configured for receiving the display data according to the scan order in order to refresh properly.

The processor(s) 102 may include a GPU(s) and/or a CPU(s) for rendering image data representative of still images, video images, and/or other image types. Once rendered, or otherwise suitable for display by a display device of the LCD system 100, the image data may be stored in memory 104—such as in the frame buffer 108. In some embodiments, the image data may be representative of a sub-image per panel of an LCD layer 112—e.g., in embodiments where the LCD layer 112 includes two or more panels (e.g., as in FIG. 3). As such, a single image may be divided into two or more separate images to correspond to a number of rows and/or columns of pixels are included in each panel. Each sub-image may thus have an associated scan order. For example, a first panel may be updated from bottom-up, a second panel may be updated from top-down, a third panel may be updated from middle-out, etc. As such, the scan order may be such that the display data generated for each panel corresponds to the hardware architecture of the panel.

The LCD layer(s) 112 may include any number of cells (or valves) that may each correspond to a pixel or a sub-pixel of a pixel. For example, the LCD layer(s) 112 may include a red, green, and blue (RGB) layer where each cell may correspond to a sub-pixel having an associated color (e.g. red, green, or blue) associated therewith via one or more color filter layers of the LCD system 100. As such, a first cell may correspond to a first sub-pixel with a red color filter in series therewith, a second cell may correspond to a second sub-pixel with a blue color filter in series therewith, and so on. Although an RGB layer is described herein, this is not intended to be limiting, and any different individual color or combination of colors may be used depending on the embodiment. For example, in some embodiments, the LCD layer(s) 112 may include a monochrome or grayscale (Y) layer that may correspond to some grayscale range of colors from black to white. As such, a cell of a Y layer may be adjusted to correspond to a color on the grayscale color spectrum.

Once the values (e.g., color values, voltage values, capacitance values, etc.) are determined for each cell of each LCD layer 112—e.g., using the frame buffer 108, the video controller 110, etc.—signals corresponding to the values may be applied to each cell via row drivers and column drivers controlled according to shift registers and a clock. For example, for a given cell, a row driver corresponding to the row of the cell may be activated according to a shift register (e.g., activated to a value of 1 via a corresponding flip-flop), and a column driver corresponding to the column of the cell may be activated to drive a signal—e.g., carrying a voltage—to a transistor/capacitor pair of the cell. As a result, the capacitor of the cell may be charged to a capacitance value corresponding to the color value for the current frame of the image data. This process may be repeated according to a scan order—e.g., from top left to bottom right, middle-out, etc.—for each cell of each LCD layer 112.

Figure 2A:
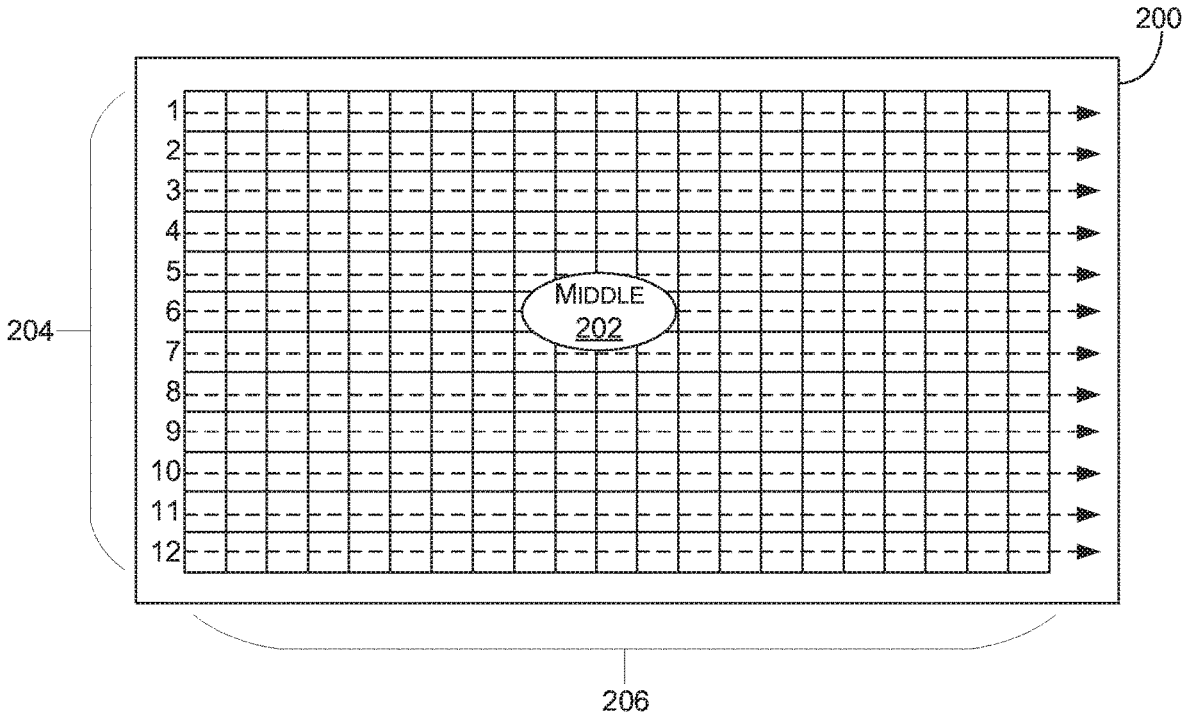
FIG. 2A depicts an example illustration of a top-down scan order, in accordance with some embodiments of the present disclosure.

As described herein, and with reference to FIG. 2A, conventional scan orders include a top-down, left-to-right order such that a top-most line or row of pixels 204 is scanned out first, from left to right, then a second-to-top-most line or row of pixels 204 is scanned out second, from left to right, and so on, incrementally and line by line until the bottom-most line or row of pixels is scanned out. For example, visualization 200 of FIG. 2A includes a matrix of pixel elements delineated by rows of pixels 204 with a corresponding number (e.g., a number from 1-12) and columns of pixels 206. This conventional top-down scan order starts with the row of pixels 204 labeled with a "1" and proceeds through to the row or pixels 204 labeled with a "12". Similarly, to accommodate display data received according to this top-down scan order, the display device is configured to update or refresh a top-most row of pixels first, then a second row of pixels, then a third row of pixels, and so on, until a bottom-most row of pixels is updated or refreshed. As such, a top-most shift register element may receive a value of "1" at a first clock interval triggering the values from the column drivers to be applied to the cells of the top-most row of pixels, at the next clock interval the "1" may be propagated to a next shift register element (e.g., flip-flop) to trigger the values from the column drivers to be applied to the cells of the second row of pixels, and so on, until the entire display is refreshed according to the top-down scan order. However, this conventional top-down scan order requires that the top half of the image is scanned out prior to reaching a center or middle region 202 of the display. As a result, a significant part of the display latency is consumed by the time to scan from the top of the image to the middle region 202 of the screen.

To decrease the display latency—e.g., the time from a first pixel being refreshed to a middle pixel of a middle row being refreshed—a middle-out scan order may be executed. For example, and with reference to FIG. 2B, a middle-out, left-to-right (or right-to-left, or middle to right, or middle to left, or another order, although not shown) scan order may be implemented such that a middle row of pixels 204 is scanned out first, then a first row below (or above, although not shown), then a first row above (or below, although not shown), then a second row below, then a second row above, and so on, until the bottom-most line or row of pixels and the top-most line or row of pixels is scanned out. For example, visualization 200 of FIG. 2B includes a matrix of pixel elements delineated by rows of pixels 204 with a corresponding number (e.g., a number from 1-12) and columns of pixels 206. This middle-out scan order starts with the row of pixels 204 labeled with a "1" and proceeds through, in order, to the row or pixels 204 labeled with a "12". Similarly, to accommodate display data received according to this middle-out scan order, the display device may be configured to update or refresh a middle row of pixels from the middle region 202 first (e.g., each cell in a row may be updated at one time with the values from the column drivers when a shift register element corresponding to the row has the high value, such as a "1"), then a second row of pixels below (or above) the middle row, then a third row of pixels above (or below) the middle row, then a fourth row of pixels below (or above) the second row of pixels, then a fifth row of pixels below (or above) the third row of pixels, and so on, until a bottom-most row of pixels and a top-most row of pixels is updated or refreshed. As such, a first shift register element corresponding to the middle or initial row may receive a value of "1" at a first clock interval triggering the values from the column drivers to be applied to the cells of the middle or initial row of pixels, at the next clock interval the "1" may be propagated to a second shift register element below (or above) the first shift register element to trigger the values from the column drivers to be applied to the cells of the second row of pixels, at the next clock interval the "1" may be propagated to a third shift register element above (or below) the first shift register element to trigger the values from the column drivers to be applied to the cells of the third row of pixels, and so on, until the entire display is refreshed according to the middle-out scan order. In some embodiments, such as where there is only a single set of column drivers, each row or line of pixels may have two associated shift register elements associated therewith to allow for the ping-pong order of the row updates. In other embodiments, as described herein, the display device may be configured for top-down and middle-out (or some other) scan order. In such embodiments, the shift register elements may include combination shift register elements that may be configured according to the particular scan order that the display data is received in.

The visualization 210 of FIG. 2B includes a back and forth (or ping-pong) scan order, where a line below (or above) the initial line is updated, then a line above (or below) is the initial line is updated, and back and forth until each row or line of pixels is updated. However, this is not intended to be limiting. For example, such as illustrated in FIG. 3, a display device or LCD layer thereof may be separated into two or more panels 320—e.g., a first (or bottom) panel 320A and a second (or top) panel 320B. As such, each of the two or more panels may be updated separately—and at least partially simultaneously, in embodiments. As such, the updating would not be back and forth, but rather straight through for each panel (e.g., a top panel 320B may be updated from a bottom-most row of pixels to a top-most row of pixels at substantially the same time that a bottom panel 320A is updated from a top-most row of pixels to a bottom-most row of pixels). As a result, the display device may be refreshed twice as quickly as a single panel embodiment, and the display may still be refreshed from the middle-out thereby reducing the display latency. In such embodiments, there may be a set of column drivers for each panel 320, such that each panel 320 may be updated at least partially simultaneously.

Using a middle-out scan order may reduce the display latency and thus increase the user-experience, especially for high performance applications such as gaming. As an example, and with respect to a 1080p, 60 Hz display, the display latency for a middle-out scan order may be reduced to approximately 7.5 μs from approximately 8.3 ms for a top-down scan order. This reduction in display latency not only improves user experience, but also increases the desirability of the display device itself—thereby increasing the value of the product for the manufacturer as well as application developers that may leverage the middle-out scan order.

In addition, although the scan order is referred to as a middle-out scan order, this is not intended to be limiting. In some embodiments, the initial row (e.g., the first row scanned out and updated) may not be a middle row. For example, the initial row may be any row, followed by any other row, and so on, until the entire display is refreshed. To accommodate this, the display hardware and architecture may be suited for a particular scan order (e.g., an initial row may correspond to a top-row of a central third of the display, such that the shift register element corresponding to the initial row receives the initial input signal of "1" to trigger the updates), and the video controller 110 and/or the processor(s) 102 may be configured to scan the image data out of the frame buffer 108 according to the scan order.

In some embodiments, the scan order for an individual frame or image may be determined based on certain criteria and/or heuristics—such as where a user is gazing (e.g., using eye-tracking techniques), where a user input (e.g., to an I/O component(s) 106) was made to or affected the most (e.g., caused the most pixels to require an updated color value, caused the most increase in or decrease in luminance, has the most animating content, etc.), where a largest number of pixels or pixel density has a change, and/or the like. As such, the rows in the region of the display screen that the user is likely most interested in, or that have the greatest amount of change, may be refreshed more quickly than other rows of the display screen. For example, a display architecture may allow for any number of different scan orders (e.g., a data input may be received at any of a number of locations), such that a first image may be updated according to a middle-out scan order, a second image may be updated according to a top-down scan order, a third-image may be updated starting from a row in a top third of the rows and then scanning up and down from there (e.g., where a user is gazing at a top third of the display, or an input is to a top-third of the display, etc.), and so on.

Figure 2B:
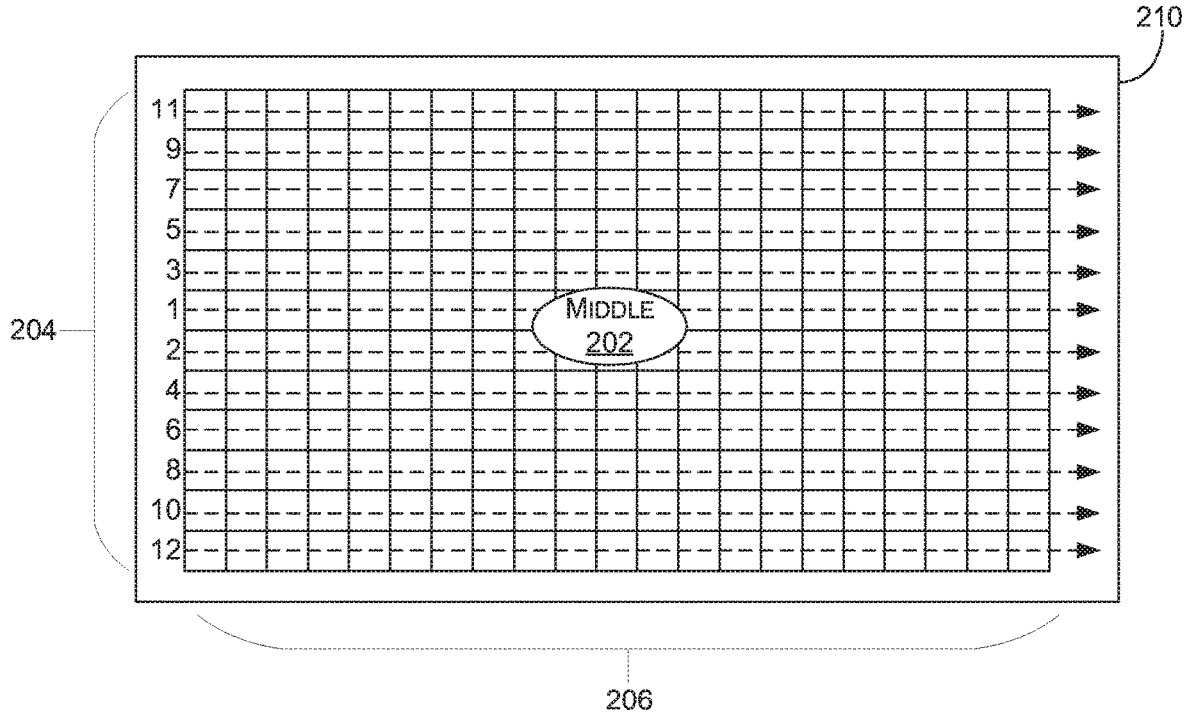
FIG. 2B depicts an example illustration of a middle-out scan order, in accordance with some embodiments of the present disclosure.
Figure 3:
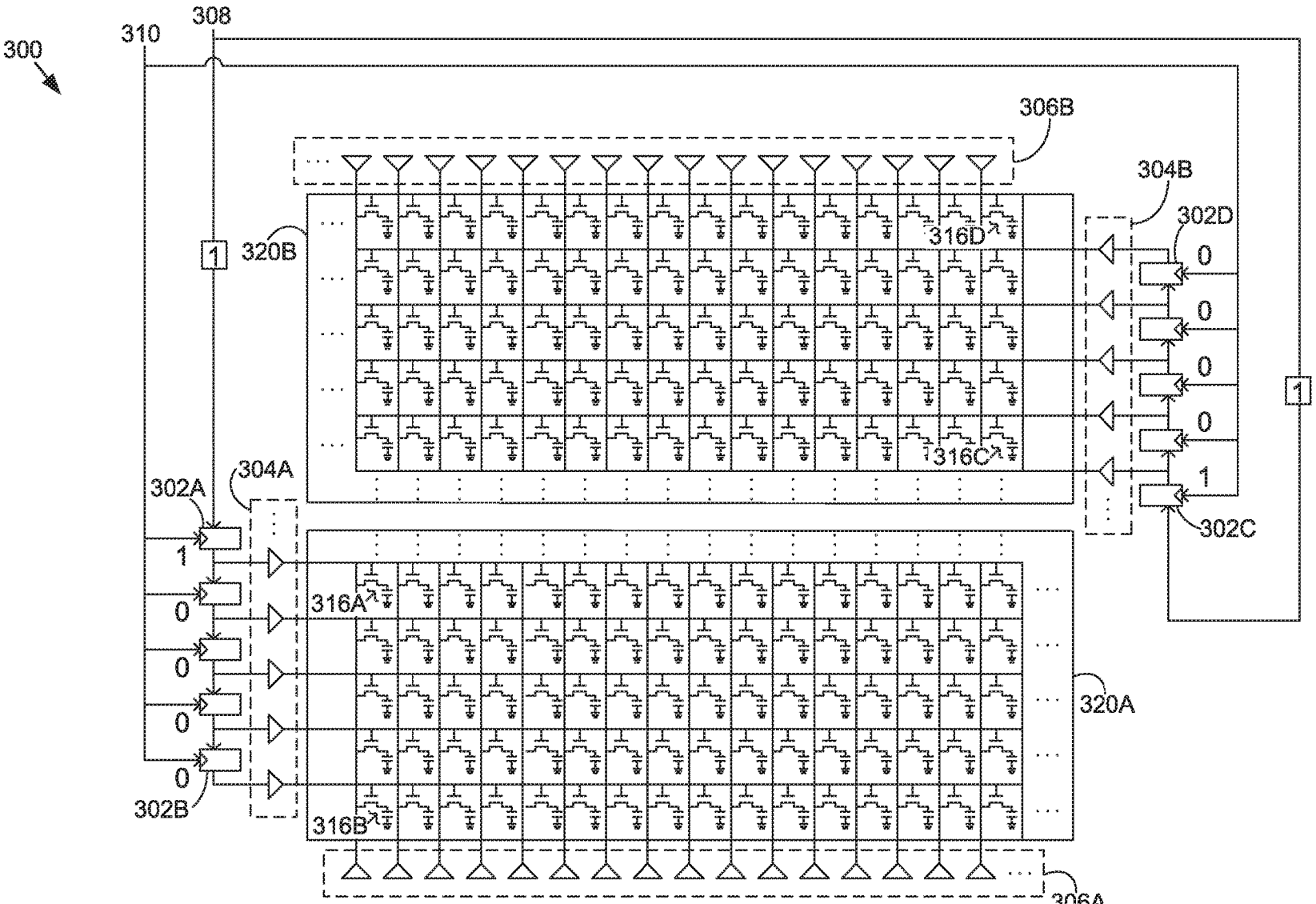
FIG. 3 depicts an example display architecture employing two panels for middle-out scanning, in accordance with some embodiments of the present disclosure.

With reference to FIGS. 2A and 2B, although 12 rows of pixels and 21 columns of pixels (or, alternatively, 7 columns of pixels represented by 21 sub-pixels in an RGB layer) are illustrated, this is not intended to be limiting. For example, where the system 100 corresponds to a 4K resolution LCD display (e.g., 3840 pixels×2160 pixels), and the LCD layer(s) 112 is an RGB layer, the RGB layer may include 11520 (e.g., 3840 pixels×3 sub-pixels per pixel) cells in each row, 11520 column drivers (per panel, for multi-panel embodiments, such as display architecture 300 of FIG. 3), 2160 cells in each column, and 2160 row drivers. Although 4K is used as an example, the resolution may differ depending on the embodiment, and may include 1080p, 8 k, 16 k, and/or another resolution without departing from the scope of the present disclosure.

Now referring to FIGS. 3-5D, FIGS. 3-5D depict example display architectures suitable for use in embodiments of the present disclosure. However, display architectures 300, 400, and 500 are not intended to be limiting, and are illustrated for example purposes only. As such, additional and/or alternative features, functionalities, and/or components other than those described herein with respect to FIGS. 3-5D may be implemented without departing from the scope of the present disclosure. For example, as described with respect to FIG. 3, subsets of row drivers 302A and 302B may be situated or disposed on a same side, may be situated or disposed on opposite sides (as illustrated) as the subsets of row drivers 302C and 302D, and/or may be otherwise situated or disposed. Similarly, with respect to FIG. 3, there may be any number of panels (e.g., two panels in the illustration of FIG. 3), such as two, three, four, ten, etc. As another example, and with respect to FIG. 4, an initial row that receives an initial data input 408 (e.g., a "1" to cause the row associated with the data input 408 to receive the values from column drivers 406) may not be a middle row (as illustrated), and may be a row other than a middle row (e.g., a row that is not the top-most row, such as a row in a middle third of the display), according to a scan order(s) that the display device is configured for. In addition, although a certain number of rows and columns are displayed in each of the display architectures 300, 400, and 500, this is not intended to be limiting and is for clarity purposes only. For example, the number of rows and/or columns may correspond to the display resolution (e.g., 1080p, 4K, 8K, etc.) and/or the type of LCD layer (e.g., monochrome, RGB, etc.). As such, even though the middle row in display architecture 500 is a fifth row, if the display architecture 500 was implemented for a 4K display, the middle row may correspond to a $1080^{th}$ line and/or a $1081^{st}$ line.

In embodiments, shift register elements 302, 402, 502 and row drivers 304, 404 and 504 may be implemented with one or more discrete row driver chips, traditional silicon which may be connected to the glass of the LCD panel or layer(s) 112 through a flex cable, and/or the shift registers may be implemented directly on the glass of the LCD itself—e.g., the LCD glass may already include transistors for each pixel or sub-pixel component (such as TFTs), so these transistors may be leveraged to implement digital logic.

Now referring to FIG. 3, FIG. 3 depicts an example display architecture 300 employing two panels for middle-out scanning, in accordance with some embodiments of the present disclosure. For example, to implement an LCD panel that supports middle-out scanning, the configuration of the LCD panel may be split in half, and treated as two separate virtual LCD panels: a top half (e.g., including row drivers 304B and column drivers 306B) and a bottom half (e.g., including row drivers 304A and column drivers 306A). In this configuration, there may be a same number of row drivers 304 as in a traditional LCD panel that supports top-down scanning, but the number of column driver 306 may be doubled (e.g., a first set of column drivers 306A for the bottom panel 320A and the a second set of column drivers 306B for the top panel 320B). In the display architecture 300, the top panel 320B—and thus the row drivers 304B—may scan from bottom (e.g., a middle of the overall LCD display) to top (e.g., a top of the overall LCD display). As such, the rows of the top panel 320B may be updated, row by row, from the row including shift register element 302C and cell 316C to the row including shift register element 302D and cell 316D. Similarly, in the display architecture 300, the bottom panel 320A—and thus the row drivers 304A—may scan from top (e.g., a middle of the overall LCD display) to bottom (e.g., a bottom of the overall LCD display). As such, the rows of the bottom panel 320A may be updated, row by row, from the row including shift register element 302A and cell 316A to the row including shift register element 302B and cell 316B.

For example, an image that is rendered and stored in the frame buffer 108 may be scanned out in two separate scan orders: a first scan order from a middle line of the image to the top line of the image for the top panel 320B and a second scan order from another middle line of the image to the bottom line of the image for the bottom panel 320A. As such, when the display architecture 300 is receiving the display data in the first scan order and the second scan order, the column drivers 306B may be updated with the values (e.g., voltage values for the cell 316 corresponding to the color values for the pixel) for the row with the "1" in the shift register element 302C and the column drivers 306A may be updated with the values for the row with the "1" in the shift register element 302A. The "1" in the shift register elements 302A and 302C may be applied to the shift registers from a data input 308 at a first clock cycle (as such, the "1" may only be present in the shift register elements 302A and 302C at a first clock cycle for a new image, and may be a low line, or "0" at other times). As such, at a first cycle of clock 310, the "1" may be applied to the shift register elements 302A and 302C, then at a second cycle of the clock 310 the "1" may be propagated to a shift register element immediately above the shift register element 302C and the shift register element immediately below the shift register element 302A. In addition, the column drivers 306A and 306B may be updated with the values corresponding to the respective row of pixels. As such, when the "1" is propagated, the values may be applied to the cells 316. This process may be repeated until the "1" has been cycled through to each shift register element for each row of the display architecture 300, and thus the entire image has been displayed on the display device.

As a result, and because the display architecture 300 includes two separate panels 320, the top panel 320B and the bottom panel 320A may be updated or refreshed at a same time, at substantially the same time, or during partially overlapping periods of time. As such, the display architecture 300 may enable the display device to be refreshed in a middle-out scan order thereby reducing the display latency, but may also enable the entire display to be refreshed at twice the rate of other approaches that employ middle-out or top-down scan orders.

Figure 4:
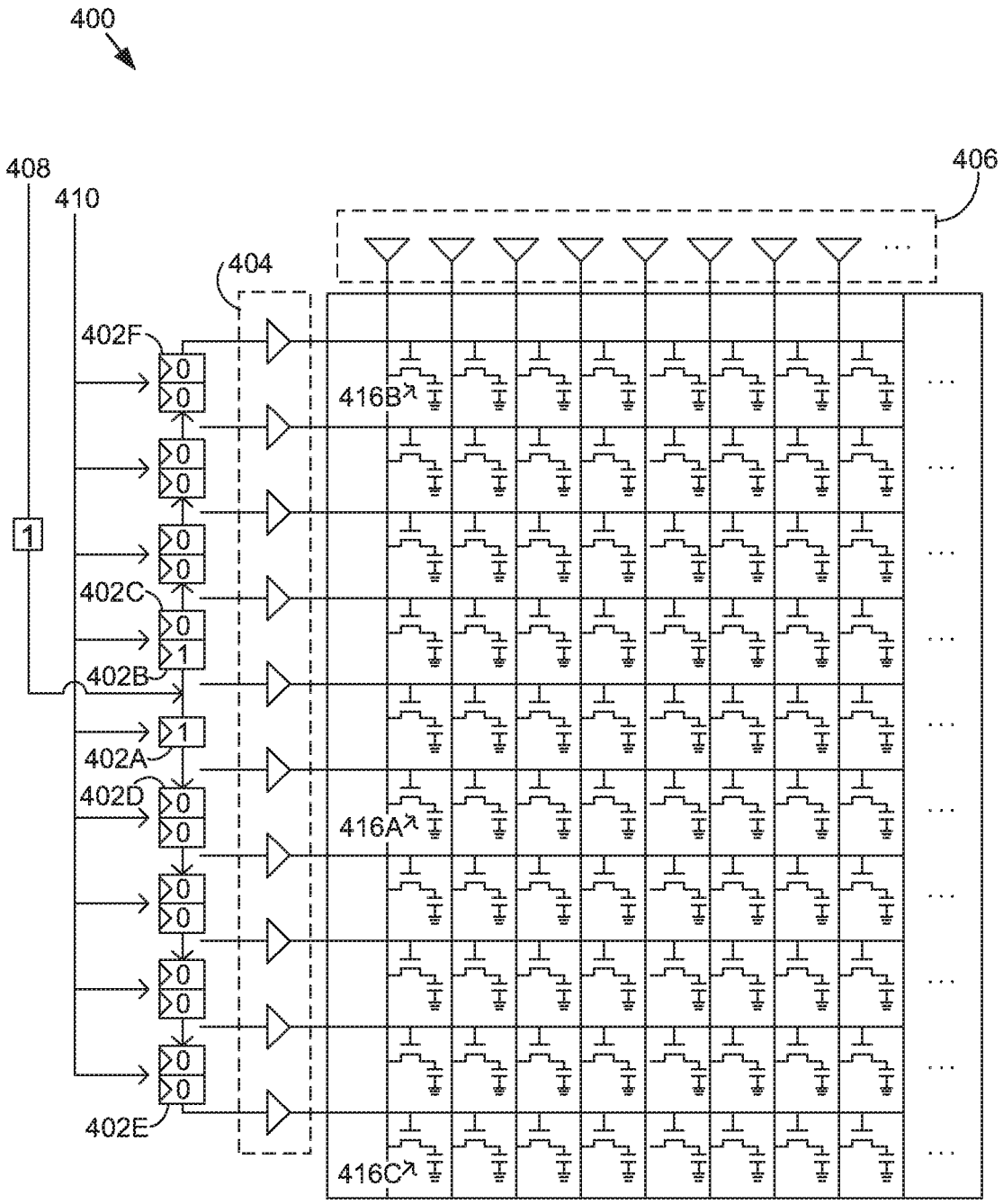
FIG. 4 depicts an example display architecture employing dual flip-flops for middle-out scanning, in accordance with some embodiments of the present disclosure.

With reference to FIG. 4, FIG. 4 depicts an example display architecture 400 employing dual flip-flops for middle-out scanning, in accordance with some embodiments of the present disclosure. For example, the display architecture 400 may update one row at a time—and thus only have one set of column drivers 406—but may alternate between updating a row of a top half of the display and a row of a bottom half of the display (e.g., as illustrated in FIG. 2B). In addition, there may be double the number of shift register elements 402 (e.g., flip-flops) corresponding to each row of pixels or row driver 404 to accommodate the ping-pong scan order. However, as illustrated, to trigger a delay causing the top half of the rows and the bottom half of the rows to be out of phase, at least one row—e.g., an initial or middle row—may include a single shift register element 402A (e.g., a single flip-flop).

As such, during a refresh or update for an image, when data input 408 is applied at a first cycle of clock 410 to trigger the refresh of the display device for an image, a "1" may be applied to the shift register element 402A and a "1" may be applied to a bottom shift register element 402B. As such, cells 416 (e.g., 416A) associated with the row of pixels corresponding to the shift register element 402A may have the values from the column drivers 406 applied thereto, while the cells 416 associated with the row of pixels corresponding to the shift register element 402B may be in a delay due to the "1" being in the shift register element 402B that does not activate a row driver 404. At a next cycle of the clock 410, the "1" may be propagated up to shift register element 402C from the shift register element 402B, and the "1" may be propagated down from the shift register element 402A to shift register element 402D. As a result, the cells 416 of the row corresponding to the shift register element 402C may have updated values from the column drivers 406 applied thereto, and the cells 416 of the row corresponding to the shift register element 402D may be in a delay, and may thus not be updated. This process may be repeated until the "1" is propagated upward to a top row of pixels (and/or sub-pixels corresponding thereto) associated with shift register element 402F and cell 416B and the "1" is propagated downward to a bottom row or pixels associated with shift register element 402E and cell 416C.

As a result, and because the display architecture 400 includes a back and forth or ping-pong update pattern, the display device may be refreshed according to the middle-out scan order such that the display latency is reduced. In addition, because a single set of column drivers may be employed, the complexity of the display architecture may be reduced.

Figure 5A:
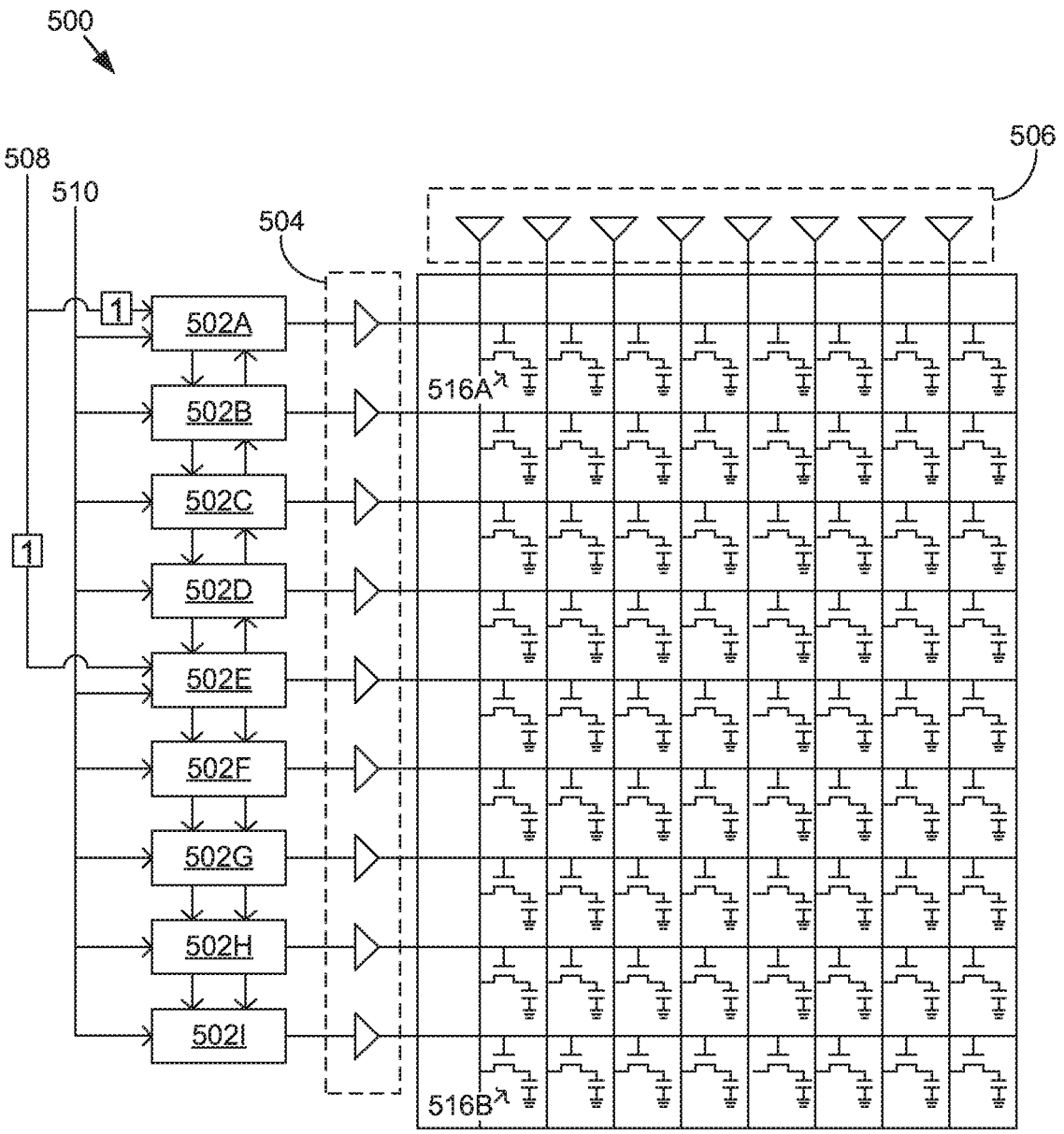
FIG. 5A depicts an example display architecture suitable for use with top-down and middle-out scanning techniques, in accordance with some embodiments of the present disclosure.
Figure 5B:
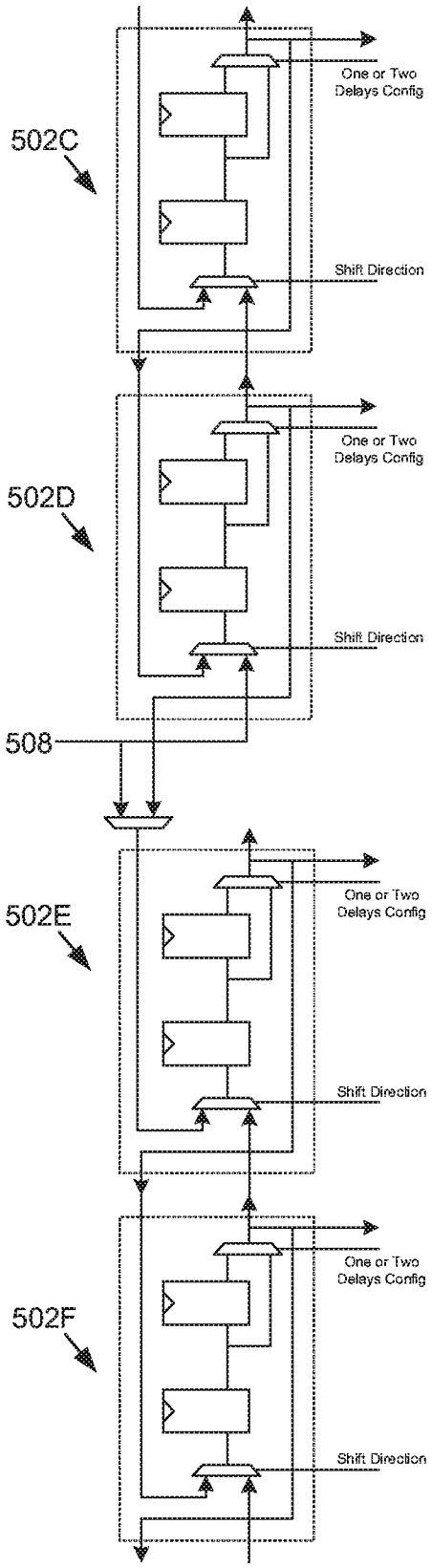
FIGS. 5B-5D depict example shift register elements for use in the display architecture of FIG. 5A, in accordance with some embodiments of the present disclosure.
Figure 5C:
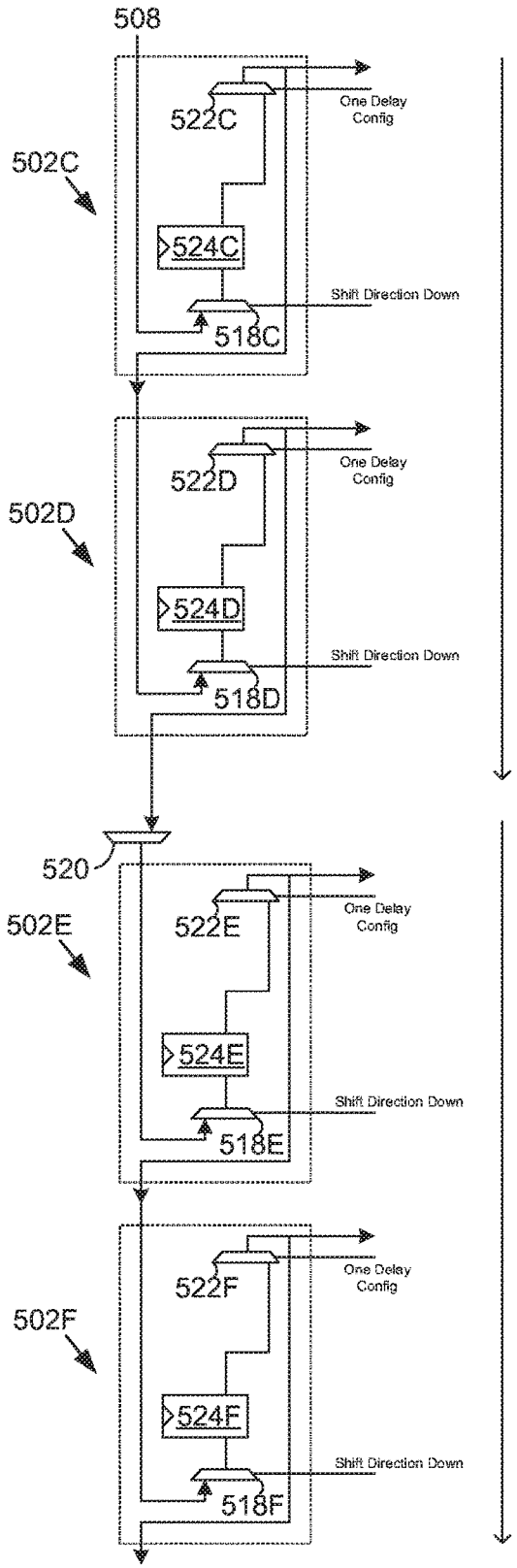
Figure 5D:
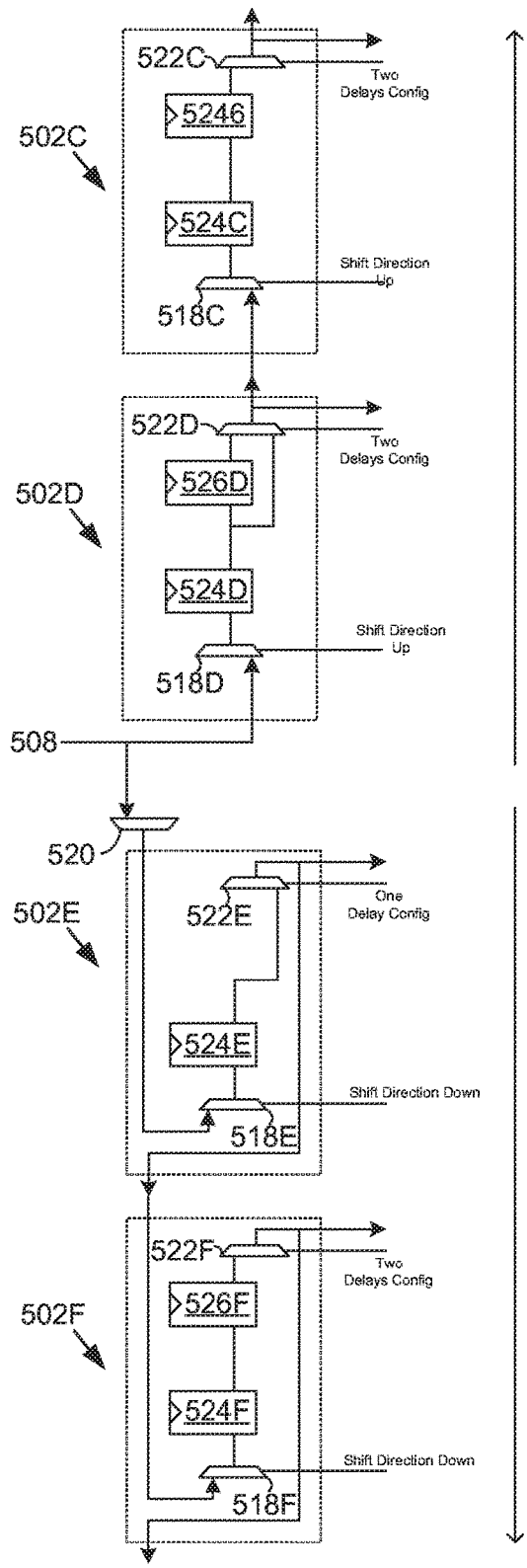

Now referring to FIG. 5A, FIG. 5A depicts an example display architecture 500 suitable for use with top-down and middle-out scanning techniques, in accordance with some embodiments of the present disclosure. For example, to achieve the low latency benefits of middle-out scanning, the source (e.g., GPU) and the sink (e.g., the display device) should both support this functionality. However, there may be various reasons why a source may not be capable of or configured to provide pixels according to a middle-out scan order—e.g., a legacy GPU may not support middle-out scanning). As such, a display architecture 500 that supports both middle-out scanning and traditional top-down scanning may be pairing the display device of the LCD system 100 within system configurations that do support middle-out scanning as well as those that do not. As such, instead of a single shift register element as deployed in the display architecture 300, or two shift register elements as deployed in the display architecture 400, the display architecture 500 may include shift register elements 502 (alternatively referred to herein as "combo shift register elements 502") that may operate with a single flip-flop or two flip-flops—e.g., as illustrated in FIG. 5B. For example, FIG. 5B illustrates an entire example architecture of the shift register elements 502, FIG. 5C may illustrate only the components of the shift register elements 502 and the path there through that may be employed for top-down scanning, and FIG. 5D may illustrate only the components of the shift register elements 502 and the path there through that may be employed for middle-out scanning. Multiplexers (or muxes) 522 (e.g., 522C-522F) may determine whether the shift register element uses one or two flip-flop register elements (corresponding to whether the combo shirt register has one or two clock-cycle delays), and multiplexers (or muxes) 518 (e.g., 518C-518F) may select the input into the shift register element 502—e.g., either from the top or from the bottom.

Where the shift register element 502 is configured for a top-down scan order, only a single flip-flop 524 (e.g., flip-flop 524C-524F) may be used at each shift register element 502. Data input 508 may be applied to a top-most shift register element 502A at a first cycle of clock 510—e.g., as illustrated by a "1" being applied to the shift register element 502A in FIG. 5A—and the "1" may be propagated downward through the shift register elements 502 (e.g., 502A, then 502B, then 502C, etc.) until each of the rows has been updated or refreshed with values driven thereto by the column drivers 506. As such, as illustrated in FIG. 5C, at each cycle of the clock 510, the data input 508 may come from the top-down for each shift register element 502, multiplexers (or muxes) 518 may be configured for shifting down and, as a result, the signal (e.g., a "1" or a "0"), for each shift register element 502, may go into the mux, out of the mux 518 through the flip-flop 524, into the mux 522, and out through the mux 522 down to the next shift register element 502. At a cycle of the clock 510 where the shift register element 502 has the high signal (e.g., a "1"), the mux 522 may also pass the "1" to the row driver 504 to open the cells 516 of the row to receive the values form the column drivers 506.

Where the shift register element 502 is configured for a middle-out scan order, two flip-flops (e.g., flip-flops 524C-524F and flip-flops 526C-526F) may be used at each shift register element 502 other than a single shift register element 502E corresponding to a middle or initial row—e.g., similar to the description with respect to the display architecture 400 of FIG. 4, and also as illustrated in FIG. 5D. This may allow for the delay in the updating of the rows according to the scan order illustrated in FIG. 2B—e.g., a ping-pong scan order. Each of the muxes 518 above the middle or initial row (e.g., above the shift register element 502E) may be configured to shift up, while each of the muxes 518 below and including the middle or initial row may be configured to shift down. This may allow for the ping-pong refresh according to the middle-out scan order. At a first cycle of the clock 510, the data input 508 may be applied to a shift register element 502E via a multiplexer (or mux) 520 corresponding to a middle row of the display—e.g., as illustrated by a "1" being applied to the shift register element 502E in FIG. 5A. As illustrated in FIG. 5D, the "1" may also be applied to the shift register element 502D. As such, the "1" applied to the shift register element 502E may trigger the respective row of pixels to receive the values from the column drivers 506, and the "1" applied to the shift register element 502D may be applied to the flip-flop 524E as one clock cycle delay. At a next cycle of the clock 510, the "1" may be propagated from the shift register element 502E downward to the flip-flop 526F to put the shift register element 502F in a one clock cycle delay, and the "1" may be propagated from the flip-flop 524D to the flip-flop 526D of the shift register element 502D to cause the row associated with shift register element 502D to receive the values from the column drivers 506—e.g., through mux 522D. The "1" values may thus be propagated upward toward the top row of pixels including cell 516A and downwards toward the bottom row of pixels including cell 516B such that the rows of pixels are updated in a ping-pong or back and forth order—e.g., according to the scan order of FIG. 2B.

Referring again to each of the display architectures 300, 400, and 500 of FIGS. 3-5D, and/or additional or alternative display architectures not illustrated herein, any of the display architectures may be used as a sub-panel of a single larger display screen—such as an LCD display screen. For example, a display screen may be formed of two-dimensional (2D) grids of smaller sub-panels. Each sub-panel may operate as either middle-out scanning, traditional top-down scanning, and/or according to another scan pattern, such as but not limited to those described herein. In such a display screen, certain of the sub-panels may be updated prior to other sub-panels, one or more of the sub-panels may be updated at a same time, or all of the sub-panels may be updated substantially simultaneously.

For a non-limiting example, if a display screen is formed of a 5×5 grid of sub-panels, each of the inner 3×3 sub-panels may be middle-out scanning and each other sub-panel along the edges may be traditional scanning, or vice versa, or some other combination of middle-out, traditional top-down, or other scan order. In other embodiments, each of the sub-panels may operate according to a same scan order (e.g., all middle-out, all top-down, all some other scan order, etc.).

In an embodiment where inner sub-panels employ middle-out scanning and the outer sub-panels employ top-down scanning (e.g., for sub-panels below the inner sub-panels) and/or bottom-up scanning (e.g., for sub-panels above the inner sub-panels), the 5×5 sub-panels may be updated in a spiral fashion starting at the center most sub-panel and ending at one of the edge sub-panels. The center-most sub-panel in the grid may be updated by applying a middle-out scan order. Such an approach may allow the center region of the display screen to be refreshed even faster than the edge regions of the display screen.

In some embodiments, the order in which the 5×5 grid of sub-panels are updated may be based on the sub-panel that the user is gazing mostly upon (e.g., using eye-tracking techniques), the sub-panel that a user input (e.g., to an I/O component(s) 106) was made to or affected the most (e.g., caused the most pixels to require an updated color value, caused the most increase in or decrease in luminance, has the most animating content, etc.), and/or the like. As such, the region of the display screen that the user is likely most interested in, or that has the greatest amount of change, may be refreshed more quickly than other sub-panels of the display screen. Although various examples of an order or pattern of updating the sub-panels are described herein, this is not intended to be limiting, and other criteria and/or heuristics may be employed to determine—dynamically, in embodiments—an order of updating the sub-panels. In addition, although a 5×5 grid of sub-panels is used as an example, this is not intended to be limiting, and the grid may include a 2×2 grid, a 3×3 grid, a 4×3 grid, a 3×4 grid, a 10×10 grid, and/or another grid architecture.

Figure 6:
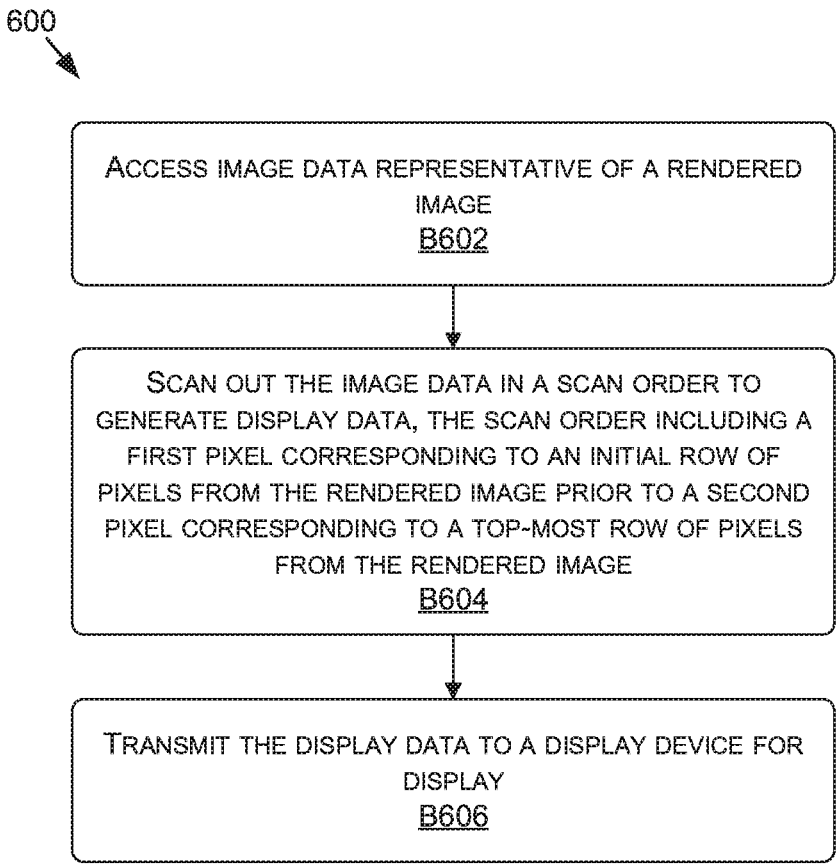
FIG. 6 includes an example flow diagram illustrating a method for middle-out scanning, in accordance with some embodiments of the present disclosure.

Now referring to FIG. 6, each block of method 600, described herein, comprises a computing process that may be performed using any combination of hardware, firmware, and/or software. For instance, various functions may be carried out by a processor executing instructions stored in memory. The method 600 may also be embodied as computer-usable instructions stored on computer storage media. The method 600 may be provided by a standalone application, a service or hosted service (standalone or in combination with another hosted service), or a plug-in to another product, to name a few. In addition, method 600 is described, by way of example, with respect to the system 100 of FIG. 1. However, this method 600 may additionally or alternatively be executed by any one system, or any combination of systems, including, but not limited to, those described herein.

FIG. 6 includes an example flow diagram illustrating a method 600 for middle-out scanning, in accordance with some embodiments of the present disclosure. The method 600, at block B602, includes accessing image data representative of a rendered image. For example, the processor(s) 102 may render an image and store the image—e.g., as image data—in the memory 104, such as in the frame buffer 108.

The method 600, at block B604, includes scanning out the image data in a scan order to generate display data, the scan order including a first pixel corresponding to an initial row of pixels from the rendered image prior to a second pixel corresponding to a top-most row of pixels from the rendered image. For example, the video controller 110 may scan out the image data from the frame buffer 108 according to a scan order to generate the display data (e.g., the data representative of color values, voltage values, capacitance values, etc.). The scan order may correspond to a middle-out scan order such as described herein with respect to FIG. 2B, or may correspond to another scan order other than the conventional top-down scan order. For example, the scan order may include one or more rows of pixels from a middle third of the display prior to updating a top-most row of pixels or an upper third and a bottom third of the display. In some embodiments, a first subset of rows of the display (e.g., a middle third) may be updated according to one scan order (e.g., middle-out), a top third of the display may be updated according to another scan order (e.g., middle out, top-down, bottom-up, etc.), and a bottom third of the display may be updated according to another scan order (e.g., middle-out, top-down, bottom-up, etc.). As such, the display may be updated according to various scan orders.

The method 600, at block B606, includes transmitting the display data to a display device for display. For example, the display data may be transmitted—e.g., in serial fashion—to the display device that may include the LCD layer(s) 112 and/or another layer type depending on the type of display technology employed by the display device.

Example Computing Device

Figure 7:
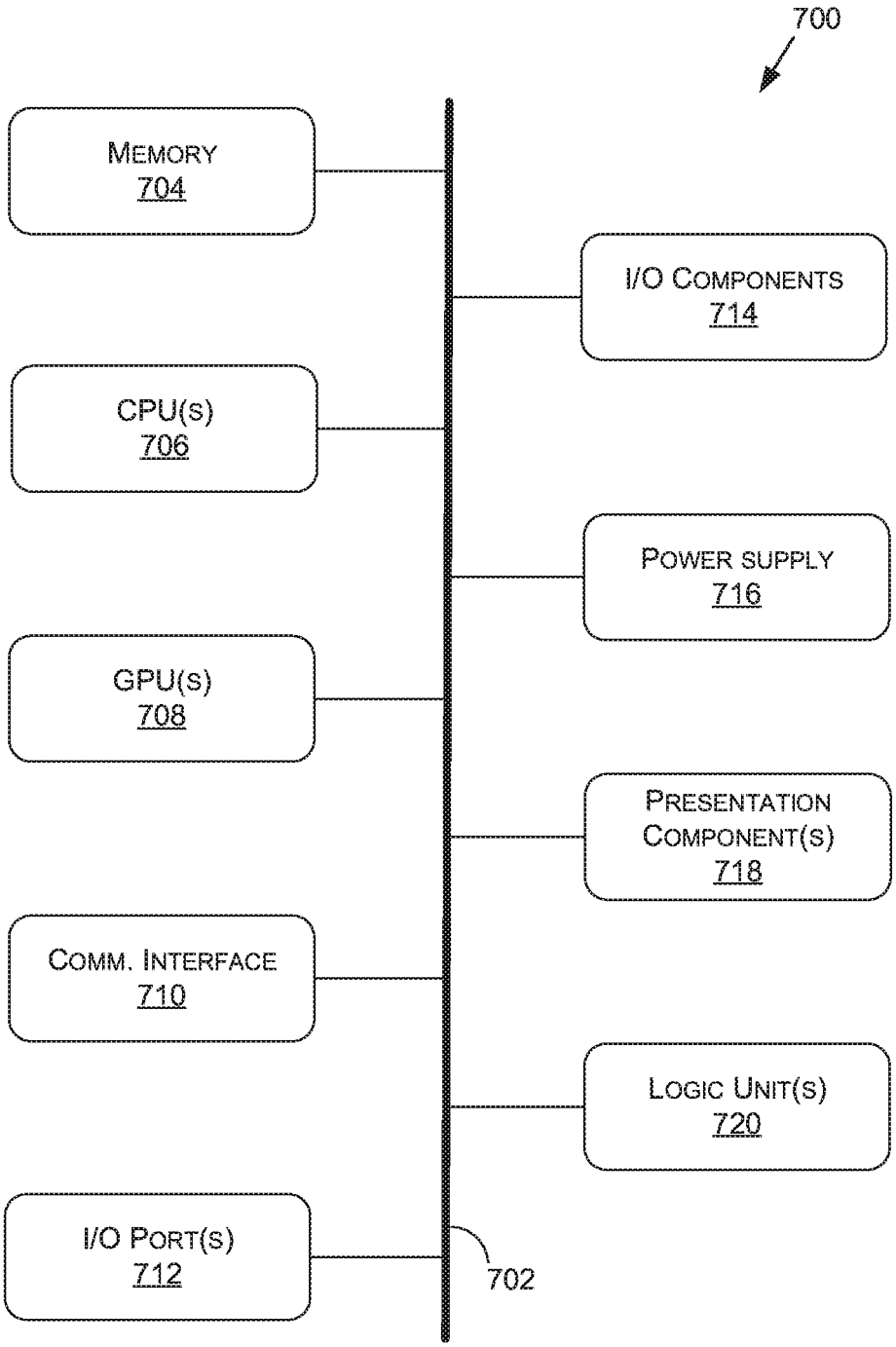
FIG. 7 is a block diagram of an example computing device suitable for use in implementing some embodiments of the present disclosure.

FIG. 7 is a block diagram of an example computing device(s) 700 suitable for use in implementing some embodiments of the present disclosure. Computing device 700 may include an interconnect system 702 that directly or indirectly couples the following devices: memory 704, one or more central processing units (CPUs) 706, one or more graphics processing units (GPUs) 708, a communication interface 710, input/output (I/O) ports 712, input/output components 714, a power supply 716, one or more presentation components 718 (e.g., display(s)), and one or more logic units 720.

Although the various blocks of FIG. 7 are shown as connected via the interconnect system 702 with lines, this is not intended to be limiting and is for clarity only. For example, in some embodiments, a presentation component 718, such as a display device, may be considered an I/O component 714 (e.g., if the display is a touch screen). As another example, the CPUs 706 and/or GPUs 708 may include memory (e.g., the memory 704 may be representative of a storage device in addition to the memory of the GPUs 708, the CPUs 706, and/or other components). In other words, the computing device of FIG. 7 is merely illustrative. Distinction is not made between such categories as "workstation," "server," "laptop," "desktop," "tablet," "client device," "mobile device," "hand-held device," "game console," "electronic control unit (ECU)," "virtual reality system," and/or other device or system types, as all are contemplated within the scope of the computing device of FIG. 7.

The interconnect system 702 may represent one or more links or busses, such as an address bus, a data bus, a control bus, or a combination thereof. The interconnect system 702 may include one or more bus or link types, such as an industry standard architecture (ISA) bus, an extended industry standard architecture (EISA) bus, a video electronics standards association (VESA) bus, a peripheral component interconnect (PCI) bus, a peripheral component interconnect express (PCIe) bus, and/or another type of bus or link. In some embodiments, there are direct connections between components. As an example, the CPU 706 may be directly connected to the memory 704. Further, the CPU 706 may be directly connected to the GPU 708. Where there is direct, or point-to-point connection between components, the interconnect system 702 may include a PCIe link to carry out the connection. In these examples, a PCI bus need not be included in the computing device 700.

The memory 704 may include any of a variety of computer-readable media. The computer-readable media may be any available media that may be accessed by the computing device 700. The computer-readable media may include both volatile and nonvolatile media, and removable and non-removable media. By way of example, and not limitation, the computer-readable media may comprise computer-storage media and communication media.

The computer-storage media may include both volatile and nonvolatile media and/or removable and non-removable media implemented in any method or technology for storage of information such as computer-readable instructions, data structures, program modules, and/or other data types. For example, the memory 704 may store computer-readable instructions (e.g., that represent a program(s) and/or a program element(s), such as an operating system. Computer-storage media may include, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by computing device 700. As used herein, computer storage media does not comprise signals per se.

The computer storage media may embody computer-readable instructions, data structures, program modules, and/or other data types in a modulated data signal such as a carrier wave or other transport mechanism and includes any information delivery media. The term "modulated data signal" may refer to a signal that has one or more of its characteristics set or changed in such a manner as to encode information in the signal. By way of example, and not limitation, the computer storage media may include wired media such as a wired network or direct-wired connection, and wireless media such as acoustic, RF, infrared and other wireless media. Combinations of any of the above should also be included within the scope of computer-readable media.

The CPU(s) 706 may be configured to execute at least some of the computer-readable instructions to control one or more components of the computing device 700 to perform one or more of the methods and/or processes described herein. The CPU(s) 706 may each include one or more cores (e.g., one, two, four, eight, twenty-eight, seventy-two, etc.) that are capable of handling a multitude of software threads simultaneously. The CPU(s) 706 may include any type of processor, and may include different types of processors depending on the type of computing device 700 implemented (e.g., processors with fewer cores for mobile devices and processors with more cores for servers). For example, depending on the type of computing device 700, the processor may be an Advanced RISC Machines (ARM) processor implemented using Reduced Instruction Set Computing (RISC) or an x86 processor implemented using Complex Instruction Set Computing (CISC). The computing device 700 may include one or more CPUs 706 in addition to one or more microprocessors or supplementary co-processors, such as math co-processors.

In addition to or alternatively from the CPU(s) 706, the GPU(s) 708 may be configured to execute at least some of the computer-readable instructions to control one or more components of the computing device 700 to perform one or more of the methods and/or processes described herein. One or more of the GPU(s) 708 may be an integrated GPU (e.g., with one or more of the CPU(s) 706 and/or one or more of the GPU(s) 708 may be a discrete GPU. In embodiments, one or more of the GPU(s) 708 may be a coprocessor of one or more of the CPU(s) 706. The GPU(s) 708 may be used by the computing device 700 to render graphics (e.g., 3D graphics) or perform general purpose computations. For example, the GPU(s) 708 may be used for General-Purpose computing on GPUs (GPGPU). The GPU(s) 708 may include hundreds or thousands of cores that are capable of handling hundreds or thousands of software threads simultaneously. The GPU(s) 708 may generate pixel data for output images in response to rendering commands (e.g., rendering commands from the CPU(s) 706 received via a host interface). The GPU(s) 708 may include graphics memory, such as display memory, for storing pixel data or any other suitable data, such as GPGPU data. The display memory may be included as part of the memory 704. The GPU(s) 708 may include two or more GPUs operating in parallel (e.g., via a link). The link may directly connect the GPUs (e.g., using NVLINK) or may connect the GPUs through a switch (e.g., using NVSwitch). When combined together, each GPU 708 may generate pixel data or GPGPU data for different portions of an output or for different outputs (e.g., a first GPU for a first image and a second GPU for a second image). Each GPU may include its own memory, or may share memory with other GPUs.

In addition to or alternatively from the CPU(s) 706 and/or the GPU(s) 708, the logic unit(s) 720 may be configured to execute at least some of the computer-readable instructions to control one or more components of the computing device 700 to perform one or more of the methods and/or processes described herein. In embodiments, the CPU(s) 706, the GPU(s) 708, and/or the logic unit(s) 720 may discretely or jointly perform any combination of the methods, processes and/or portions thereof. One or more of the logic units 720 may be part of and/or integrated in one or more of the CPU(s) 706 and/or the GPU(s) 708 and/or one or more of the logic units 720 may be discrete components or otherwise external to the CPU(s) 706 and/or the GPU(s) 708. In embodiments, one or more of the logic units 720 may be a coprocessor of one or more of the CPU(s) 706 and/or one or more of the GPU(s) 708.

Examples of the logic unit(s) 720 include one or more processing cores and/or components thereof, such as Tensor Cores (TCs), Tensor Processing Units (TPUs), Pixel Visual Cores (PVCs), Vision Processing Units (VPUs), Graphics Processing Clusters (GPCs), Texture Processing Clusters (TPCs), Streaming Multiprocessors (SMs), Tree Traversal Units (TTUs), Artificial Intelligence Accelerators (AIAs), Deep Learning Accelerators (DLAs), Arithmetic-Logic Units (ALUs), Application-Specific Integrated Circuits (ASICs), Floating Point Units (FPUs), input/output (I/O) elements, peripheral component interconnect (PCI) or peripheral component interconnect express (PCIe) elements, and/or the like.

The communication interface 710 may include one or more receivers, transmitters, and/or transceivers that enable the computing device 700 to communicate with other computing devices via an electronic communication network, included wired and/or wireless communications. The communication interface 710 may include components and functionality to enable communication over any of a number of different networks (e.g., the network(s) 116), such as wireless networks (e.g., Wi-Fi, Z-Wave, Bluetooth, Bluetooth LE, ZigBee, etc.), wired networks (e.g., communicating over Ethernet or InfiniBand), low-power wide-area networks (e.g., LoRaWAN, SigFox, etc.), and/or the Internet.

The I/O ports 712 may enable the computing device 700 to be logically coupled to other devices including the I/O components 714, the presentation component(s) 718, and/or other components, some of which may be built in to (e.g., integrated in) the computing device 700. Illustrative I/O components 714 include a microphone, mouse, keyboard, joystick, game pad, game controller, satellite dish, scanner, printer, wireless device, etc. The I/O components 714 may provide a natural user interface (NUI) that processes air gestures, voice, or other physiological inputs generated by a user. In some instances, inputs may be transmitted to an appropriate network element for further processing. An NUI may implement any combination of speech recognition, stylus recognition, facial recognition, biometric recognition, gesture recognition both on screen and adjacent to the screen, air gestures, head and eye tracking, and touch recognition (as described in more detail below) associated with a display of the computing device 700. The computing device 700 may be include depth cameras, such as stereoscopic camera systems, infrared camera systems, RGB camera systems, touchscreen technology, and combinations of these, for gesture detection and recognition. Additionally, the computing device 700 may include accelerometers or gyroscopes (e.g., as part of an inertia measurement unit (IMU)) that enable detection of motion. In some examples, the output of the accelerometers or gyroscopes may be used by the computing device 700 to render immersive augmented reality or virtual reality.

The power supply 716 may include a hard-wired power supply, a battery power supply, or a combination thereof. The power supply 716 may provide power to the computing device 700 to enable the components of the computing device 700 to operate.

The presentation component(s) 718 may include a display (e.g., a monitor, a touch screen, a television screen, a heads-up-display (HUD), other display types, or a combination thereof), speakers, and/or other presentation components. The presentation component(s) 718 may receive data from other components (e.g., the GPU(s) 708, the CPU(s) 706, etc.), and output the data (e.g., as an image, video, sound, etc.).

The disclosure may be described in the general context of computer code or machine-useable instructions, including computer-executable instructions such as program modules, being executed by a computer or other machine, such as a personal data assistant or other handheld device. Generally, program modules including routines, programs, objects, components, data structures, etc., refer to code that perform particular tasks or implement particular abstract data types. The disclosure may be practiced in a variety of system configurations, including hand-held devices, consumer electronics, general-purpose computers, more specialty computing devices, etc. The disclosure may also be practiced in distributed computing environments where tasks are performed by remote-processing devices that are linked through a communications network.

As used herein, a recitation of "and/or" with respect to two or more elements should be interpreted to mean only one element, or a combination of elements. For example, "element A, element B, and/or element C" may include only element A, only element B, only element C, element A and element B, element A and element C, element B and element C, or elements A, B, and C. In addition, "at least one of element A or element B" may include at least one of element A, at least one of element B, or at least one of element A and at least one of element B. Further, "at least one of element A and element B" may include at least one of element A, at least one of element B, or at least one of element A and at least one of element B.

The subject matter of the present disclosure is described with specificity herein to meet statutory requirements. However, the description itself is not intended to limit the scope of this disclosure. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

What is claimed is:

1. A method comprising:

accessing image data representative of a rendered image;

scanning out the image data in a scan order to generate display data, the scan order including a first pixel corresponding to an initial row of pixels from the rendered image prior to a second pixel corresponding to a top-most row of pixels from the rendered image; and transmitting the display data to a display device for display.

2. The method of claim 1, wherein the initial row of pixels corresponds to a middle row of pixels of the rendered image.

3. The method of claim 1, further comprising:

determining the scan order based at least in part on an instance of an application; and determining the initial row based at least in part on the determining the scan order.

4. The method of claim 3, wherein the determining the scan order is based at least in part on at least one of an input to the instance of the application, a location of a user gaze within the instance of the application, or a location of movement of an object.

5. The method of claim 1, wherein the accessing the image data is from a frame buffer, the frame buffer corresponding to a first component of the display device or a second component of a computing device communicatively coupled to the display device.

6. The method of claim 1, wherein the scan order further includes both a third pixel corresponding a second row of pixels below the first row of pixels and a fourth pixel corresponding to a third row of pixels above the first row of pixels prior to the second pixel.

7. The method of claim 1, wherein the scan order includes alternating between a first subset of rows of pixels that are above the initial row and a second subset of rows of pixels that are below the initial row until the top-most row and a bottom-most row of pixels from the rendered image are scanned out.

8. The method of claim 1, wherein the scan order includes each pixel corresponding to the initial row prior to any pixel corresponding to the top-most row.

9. The method of claim 1, wherein the display device supports alternative display data having a corresponding scan order from the top-most row of pixels incrementally downward to a bottom-most row of pixels.

10. The method of claim 1, wherein the display device includes a first panel extending from the top-most row of pixels to a first middle row of pixels and a second panel extending from a second middle row of pixels below the first middle row of pixels to a bottom-most row of pixels, wherein the scan order is such that the first middle row of pixels is scanned out prior to the top-most row of pixels and the second middle row of pixels is scanned out prior to the bottom-most row of pixels.

11. The method of claim 10, wherein a first portion of the first panel is refreshed at a same time as a second portion of the second panel.

12. The method of claim 1, wherein a first row of pixels of the display device has a single shift register element corresponding thereto and at least one other row of pixels of the display device has two shift register elements corresponding thereto.

13. The method of claim 12, wherein the first row of pixels is the initial row of pixels.

14. A method comprising:

accessing, from memory and in a scan order, image data representative of an image, the scan order including pixels from one or more lines of pixels below a top-most line of pixels and above a bottom-most line of pixels corresponding to the image prior to the top-most line of pixels and the bottom-most line of pixels; and generating display data for a display device based at least in part on the image data accessed in the scan order.

15. The method of claim 14, wherein the accessing the image data in the scan order includes accessing a subset of the image data corresponding to a middle line of pixels prior accessing other subsets of the image data corresponding to any other line of pixels.

16. The method of claim 15, wherein the scan order further includes alternating between first lines of pixels above the middle line and second lines of pixels below the middle line.

17. The method of claim 14, wherein the display device includes a first panel and a second panel, and the accessing the image data includes accessing a first subset of the image data corresponding to the first panel in a first scan order and a second subset of the image data corresponding to the second panel in a second scan order.

18. The method of claim 17, wherein the first scan order starts with a first bottom-most line of pixels of the first panel and ends with a first top-most line of pixels of the first panel, and the second scan order starts with a second top-most line of pixels of the second panel and ends with a second bottom-most line of pixels of the second panel.

19. A system comprising:

a display;

one or more processors; and one or more memory devices storing programmable instructions that, when executed by the one or more processors, cause the one or more processors to perform operations comprising:

accessing image data representative of a rendered image;

scanning out the image data in a scan order to generate display data, the scan order including an initial line of pixels corresponding to the rendered image prior to a top-most line of pixels corresponding to the rendered image; and transmitting the display data to the display.

20. The system of claim 19, wherein the display includes one of:

a first display architecture including a first panel having first column drivers and first row drivers and a second panel having second column drivers and second row drivers;

a second display architecture including two shift register elements for each line of pixels except for only a single shift register element for the initial line of pixels; or a third display architecture including a combo shift register element for each line of pixels such that the display supports top-down scanning and middle-out scanning.

* * * * *